US006247483B1

(12) United States Patent
Tung

(10) Patent No.: US 6,247,483 B1
(45) Date of Patent: Jun. 19, 2001

(54) AUTOMATIC LOCKING AND RELEASE DEVICE FOR A BEACH UMBRELLA

(76) Inventor: Benson Tung, No. 15, Taiyi Rd., Jente Hsiang, Tainan Hsien (TW)

( * ) Notice: Subject to any disclaimer, the term of this patent is extended or adjusted under 35 U.S.C. 154(b) by 0 days.

(21) Appl. No.: 09/371,477

(22) Filed: Aug. 10, 1999

(51) Int. Cl.[7] ..... A45B 25/08
(52) U.S. Cl. ..... 135/38; 135/28; 135/20.3
(58) Field of Search ..... 135/20.3, 28, 37–40, 135/15.1

(56) References Cited

U.S. PATENT DOCUMENTS

| | | | | |
|---|---|---|---|---|
| 2,937,653 | * | 5/1960 | Danciart et al. . | |
| 3,419,026 | * | 12/1968 | Evans, Jr. et al. . | |
| 4,567,907 | * | 2/1986 | Dubinsky | 135/28 X |
| 5,161,562 | * | 11/1992 | Wu | 135/20.3 |
| 5,357,994 | * | 10/1994 | Chung | 135/22 |
| 5,588,455 | * | 12/1996 | Kuo | 135/28 |
| 5,615,698 | * | 4/1997 | Ko | 135/28 |
| 5,690,132 | * | 11/1997 | Lin et al. | 135/24 |

FOREIGN PATENT DOCUMENTS

| | | | | |
|---|---|---|---|---|
| 669727 | * | 10/1964 | (IT) | 135/40 |

* cited by examiner

*Primary Examiner*—Robert Canfield
(74) *Attorney, Agent, or Firm*—Kolisch Hartwell Dickinson McCormack & Heuser

(57) ABSTRACT

An automatic locking and release device for a beach umbrella includes a hollow shaft containing two opening thereon and having a runner movably mounted around the hollow shaft, a lever having a lug and a flat head and a stop ring attached to the hollow shaft. A base member securely received in the hollow shaft, the base member has a channel and a recessed cavity with two holes and receives a fastener. The fastener contains a groove to receive a locking member moved therein and two through holes aligning with the two holes of the base member. The fastener includes a cavity defined therein, a boss extending therefrom and a linkage having a first end received in a bore of the boss and the second end moving in the cavity. A locking member extends through the groove of the fastener and includes a locking bar having an extension block and a spring. The extension block is attached to the top of the locking bar. The spring has a first end contacting a button defined on the bottom of the locking bar and a second end contacting the first end of the linkage.

7 Claims, 7 Drawing Sheets

AUTOMATIC LOCKING AND RELEASE DEVICE FOR A BEACH UMBRELLA

CROSS-REFERENCES TO RELATED APPLICATIONS

Not Applicable.

BACKGROUND OF THE INVENTION

1. Field of the Invention

The present invention relates to a beach umbrella, and more particularly, to an improved beach umbrella whose hollow shaft has an automatic locking and release device.

2. Description of the Related Art

A conventional beach umbrella comprises a hollow shaft with a hook or a pin to hold a runner of the beach umbrella when the beach umbrella is opened. One must push down the hook or pull out the pin to release and close the beach umbrella.

The beach umbrella is always bigger and taller than an ordinary umbrella, so it is not very convenient to open and close. Men often stand on a chair or a table to open or close the beach umbrella It is so dangerous and inconvenient.

The present invention has arisen to mitigate and obviate the disadvantage of the conventional beach umbrella.

BRIEF SUMMARY OF THE INVENTION

In accordance with one aspect of the present invention, there is provided an automatic locking and release device for a beach umbrella comprises a hollow shaft containing a first opening and a second opening thereon.

A lever is pivotally mounted in the hollow shaft and has a lug extending through the first opening and a flat head abutting a button on a locking bar.

A base member is securely received in the upper portion of the hollow shaft. A fastener is attached to the base member to define a chamber and movably receiving a locking member therein.

Further benefits and advantages of the present invention will become apparent after a careful reading of the detailed description with appropriate reference to the accompanying drawings.

DETAILED DESCRIPTION OF THE INVENTION

Figure 1:
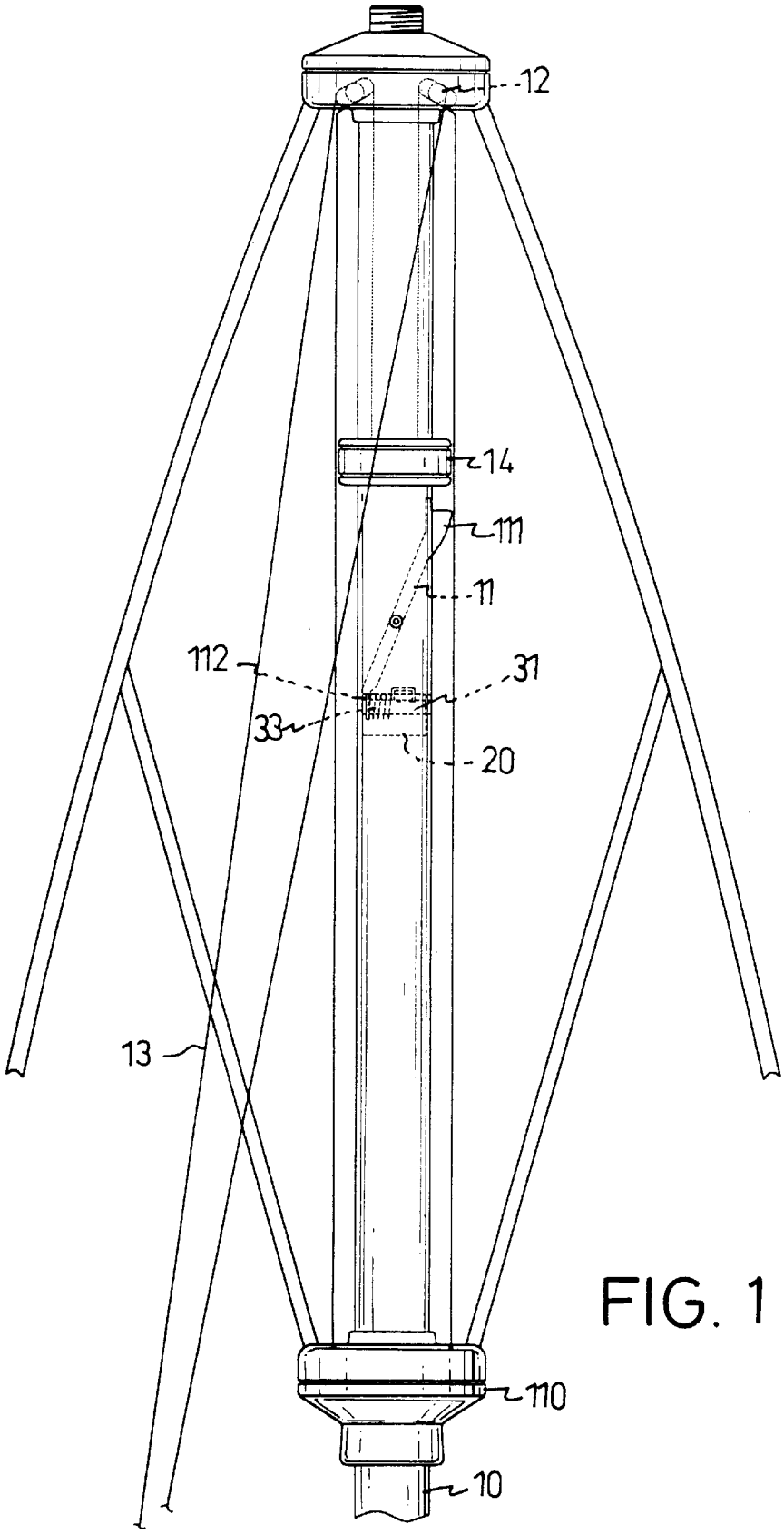
FIG. 1 is a front plan view of a beach umbrella in accordance with the present invention in a closed state.
Figure 2:
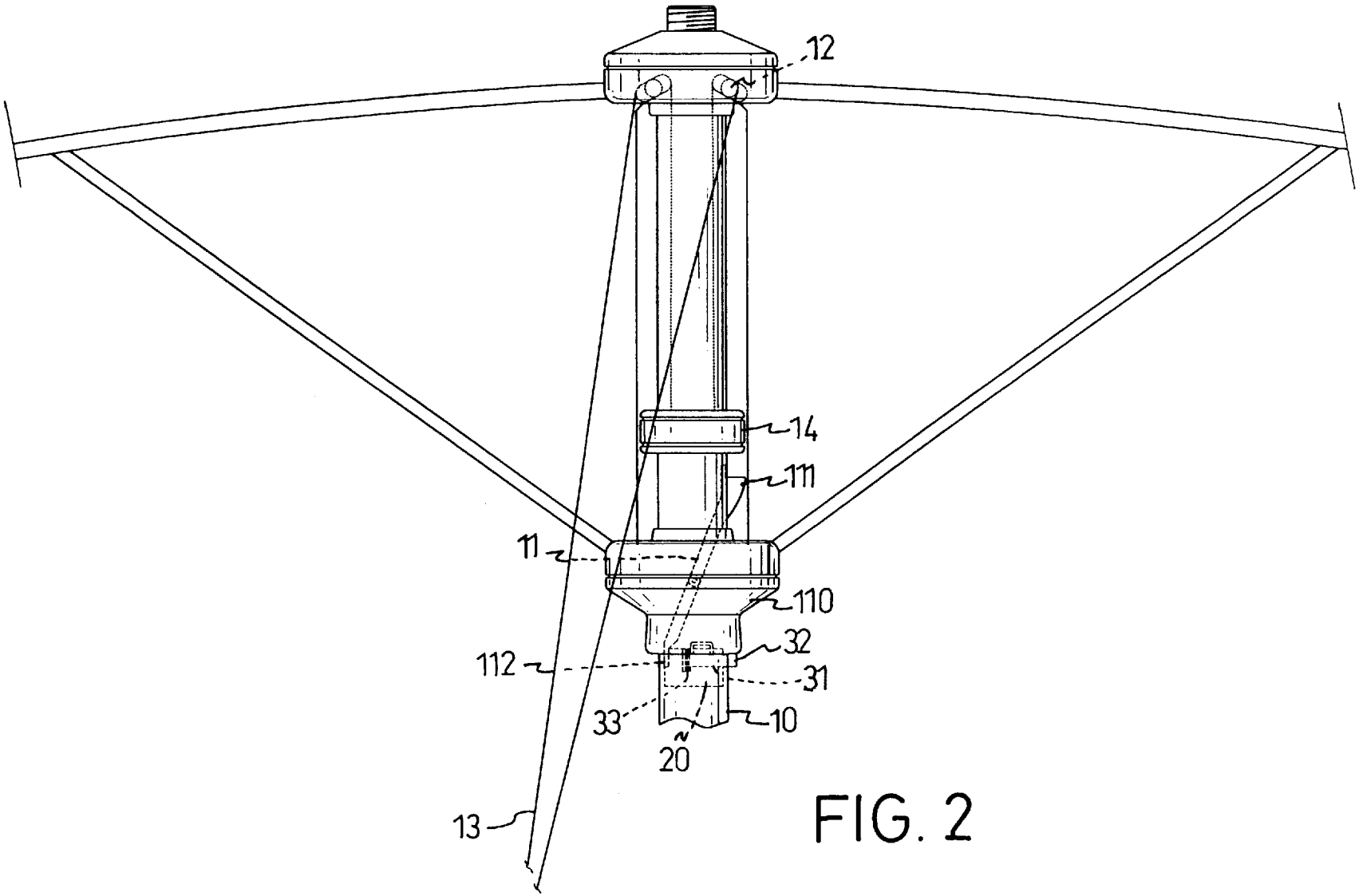
FIG. 2 is a front plan view of the beach umbrella in FIG. 1 in an opened state.
Figure 3:
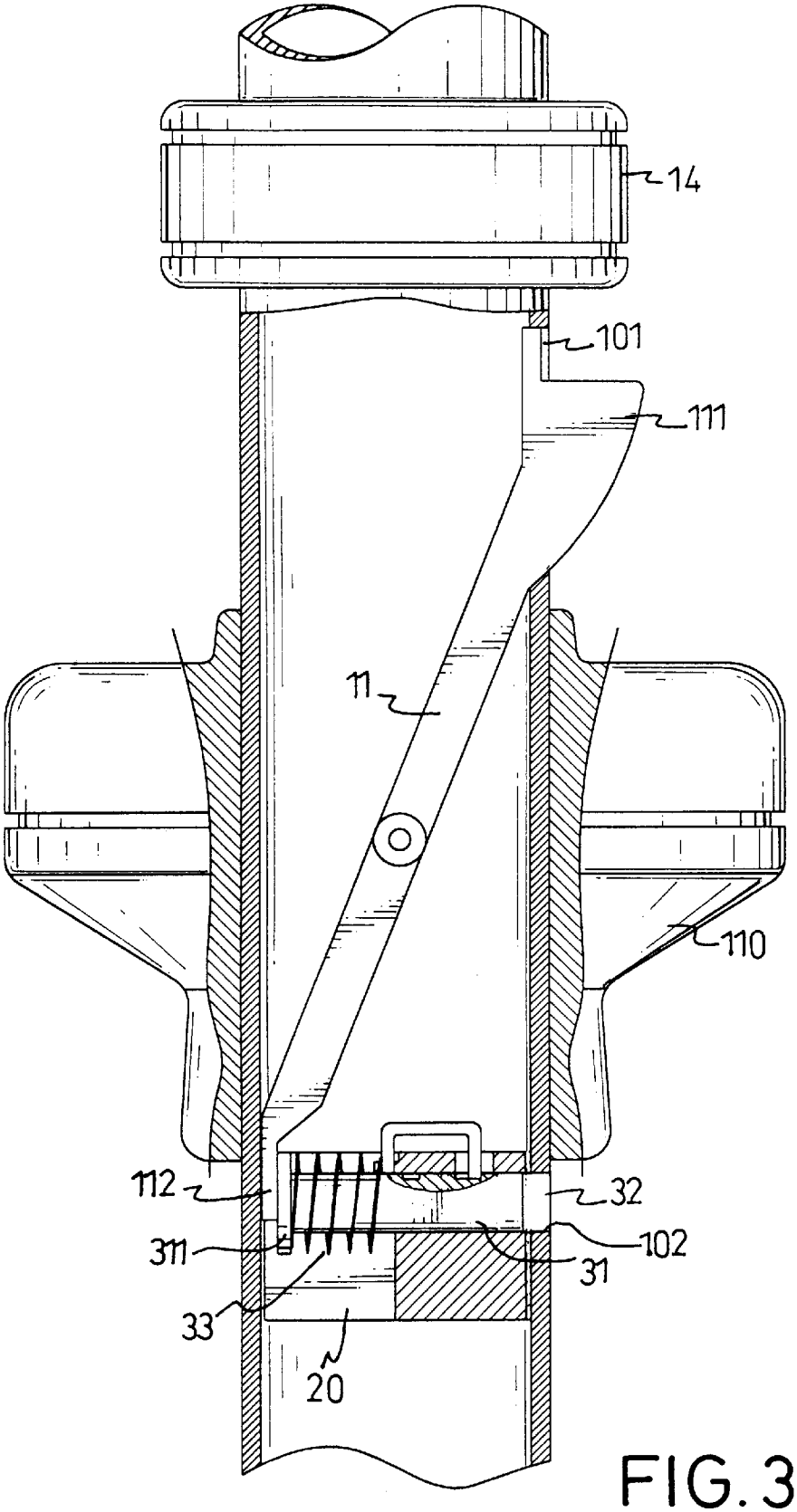
FIG. 3 is a front plan view in partial section of the locking and release section of the beach umbrella shaft in FIG. 1.
Figure 4:
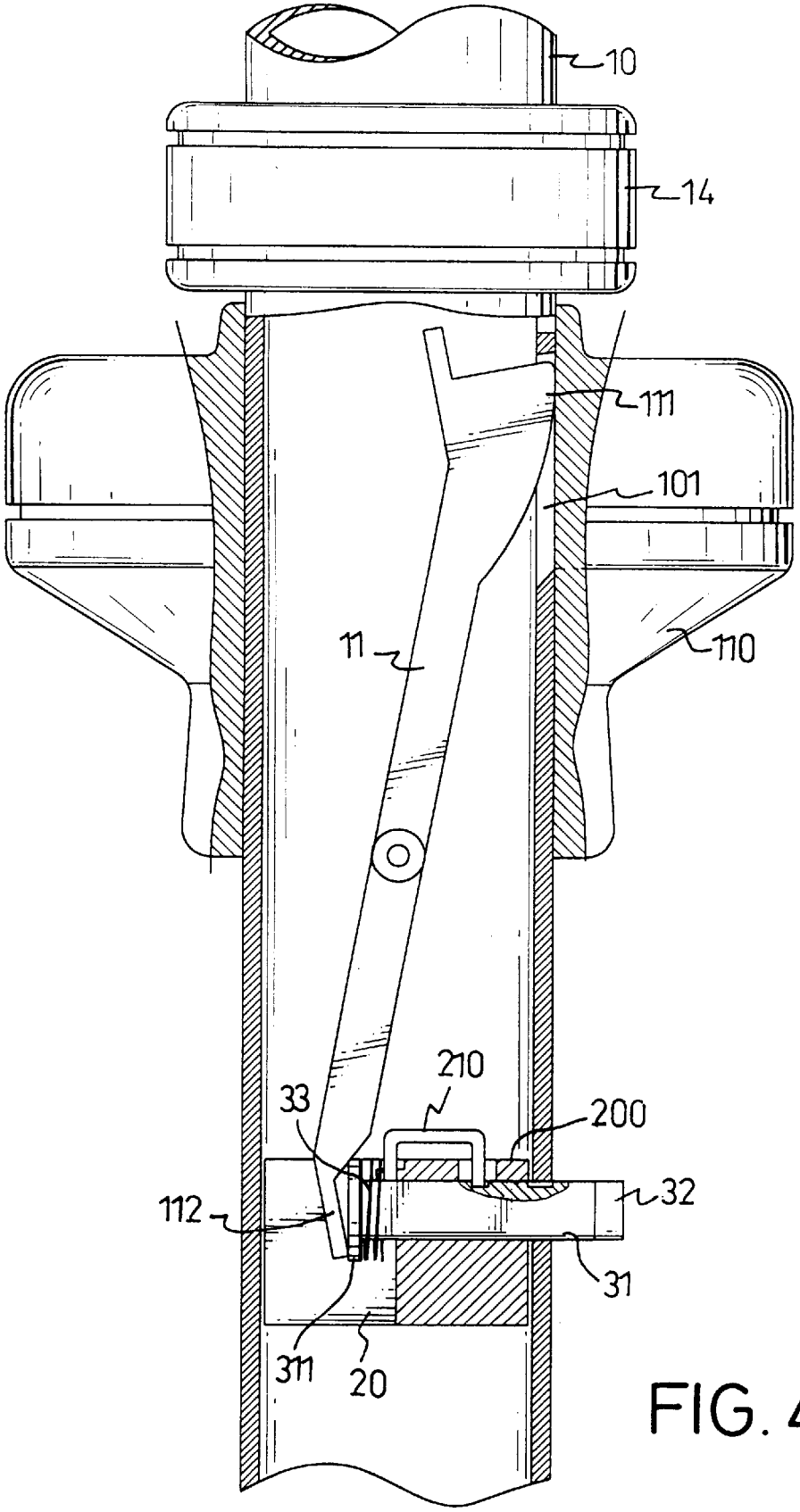
FIG. 4 is a front plan cross-sectional and operational view of the locking and release section of the beach umbrella shaft in FIG. 1.
Figure 5:
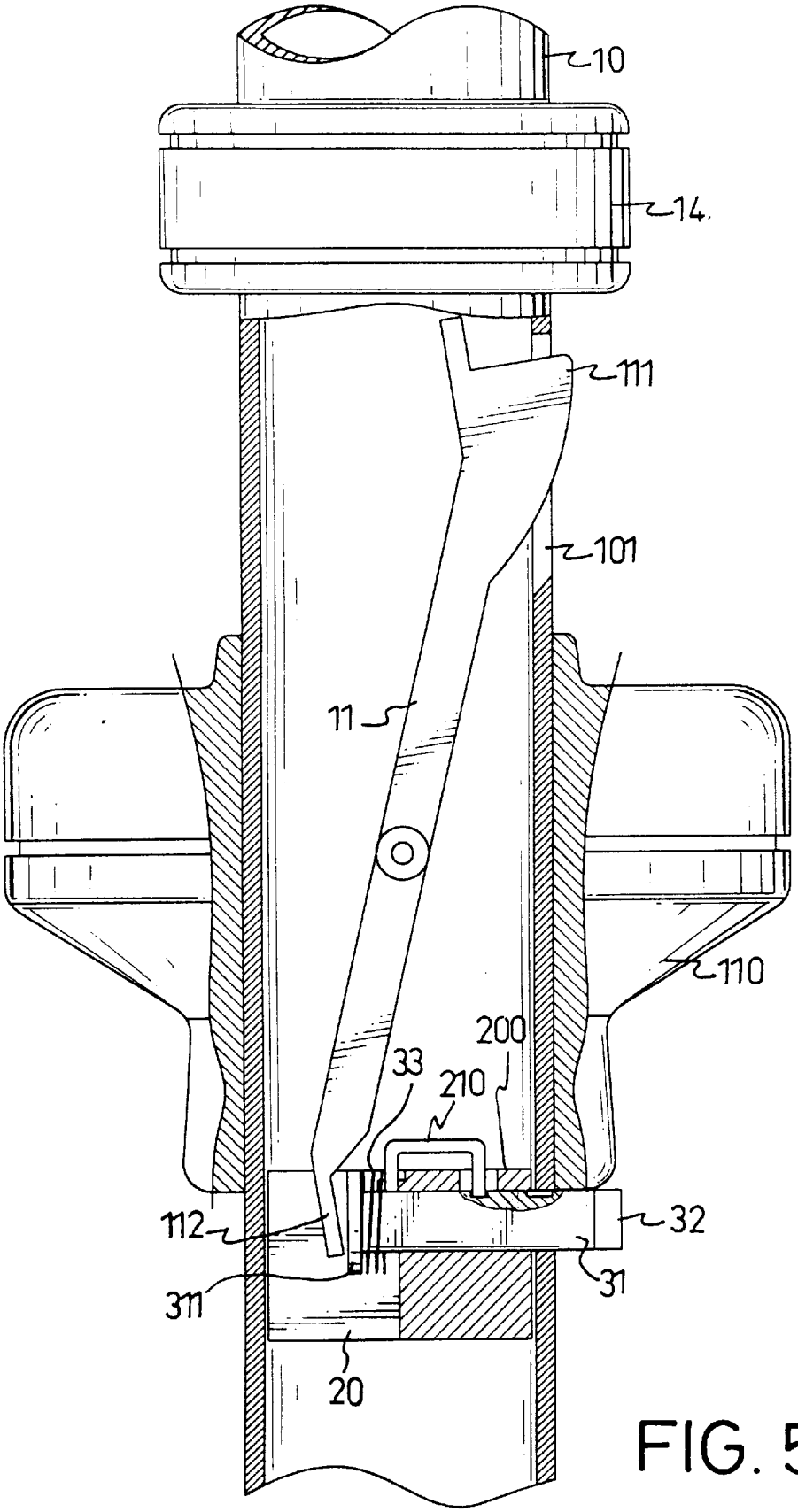
FIG. 5 is a partially exploded perspective view of the locking and release member in the shaft of the beach umbrella in FIG. 1.
Figure 6:
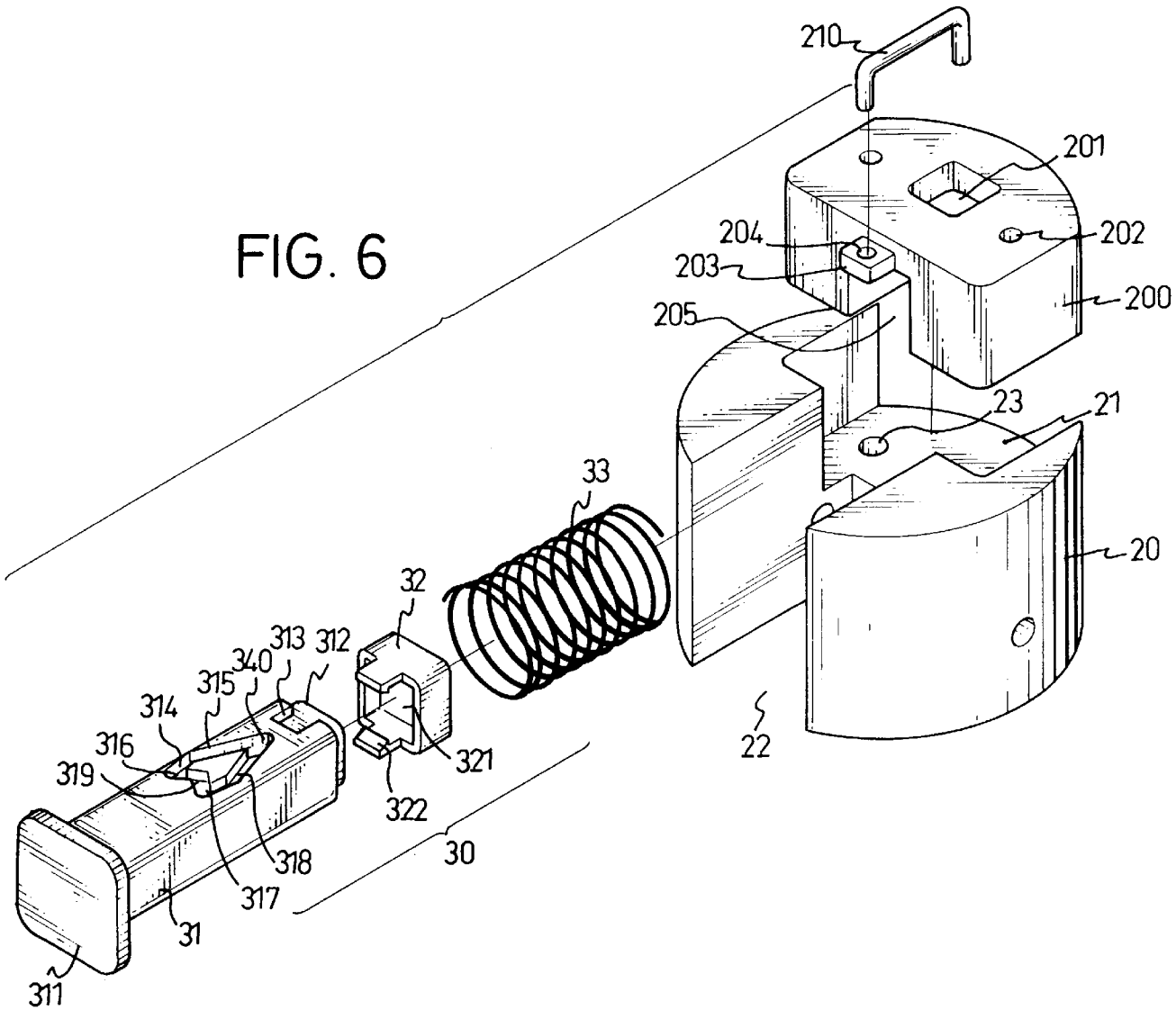
FIG. 6 is a top plan cross-sectional view of the locking and release member in the shaft of the beach umbrella in FIG. 3.

Referring to the drawings and initially to FIGS. 1–6, an automatic locking and release device for a beach umbrella in accordance with the present invention comprises a hollow shaft (10) containing a first opening (101) and a second opening (102) therein. A lever (11) is pivotally mounted in the hollow shaft (10) and has a lug (111) extending through the first opening (101) and a flat head (112) abutting a locking member (30).

A base member (20) is securely mounted in the hollow shaft (10) and contains two holes (23), a recessed cavity (21) and a channel (22). The recessed cavity (21) is perpendicular to the channel (22). The base member (20) further includes a fastener (200) received therein. The fastener (200) contains a cavity (201) and two through holes (202), the two through holes (202) are aligned with the two hole (23) of the base member (20). The fastener (200) has a boss (203) extending therefrom and containing a bore (204), and contains a groove (205) movably receiving the locking member (30) therein.

The fastener (200) further includes a U-shaped linkage (210) having a first end pivotally received in the bore (204) of the boss (203) and a second end moving in the cavity (201) of the fastener (200), and the first end of the linkage (210) is shorter than the second end of the linkage (210).

The locking member (30) extends through the groove (205) of the fastener (200) and includes a locking bar (31) having a first end with a button (311) having a first side and a second side, and the second end having a tang (312) extending therefrom and a pair of indentions (313) contained therein.

The locking member (30) further includes an extension block (32) and a spring (33). The extension block (32) has a chamber (321) to receive the tang (312) therein and two hooks (322) attaching to said indentions (313) of the locking bar (31). The spring (33) has a first end abutting the second side of the button (311) and a second end abutting the first end of the linkage (210).

An triangular groove (314) has a tip (340) and a bottom containing a socket (319) and moveably receiving the second end of the linkage (210) therein. The triangular groove (314) includes a first portion (315), a second portion (316) abutting the first portion (315), a third portion (317) abutting the second portion (316) and a fourth portion (318) abutting the third portion (317) and the first portion (315). The first portion (315) has a taper and the socket (319) is higher than the tip (340), and the fourth portion (318) has a taper and the socket (319) is lower than the tip (340).

The hollow shaft further includes two pulleys (12), two cords (13), and a stop ring (14). The two pulleys (12) are attached to the upper portion of the hollow shaft (10) and the two cords (13) are reeved through the two pulleys (12) and attached to the runner (110). The stop ring (14) is attached to the hollow shaft (10) to prevent the runner (110) from moving over the lug (111).

Figure 7:
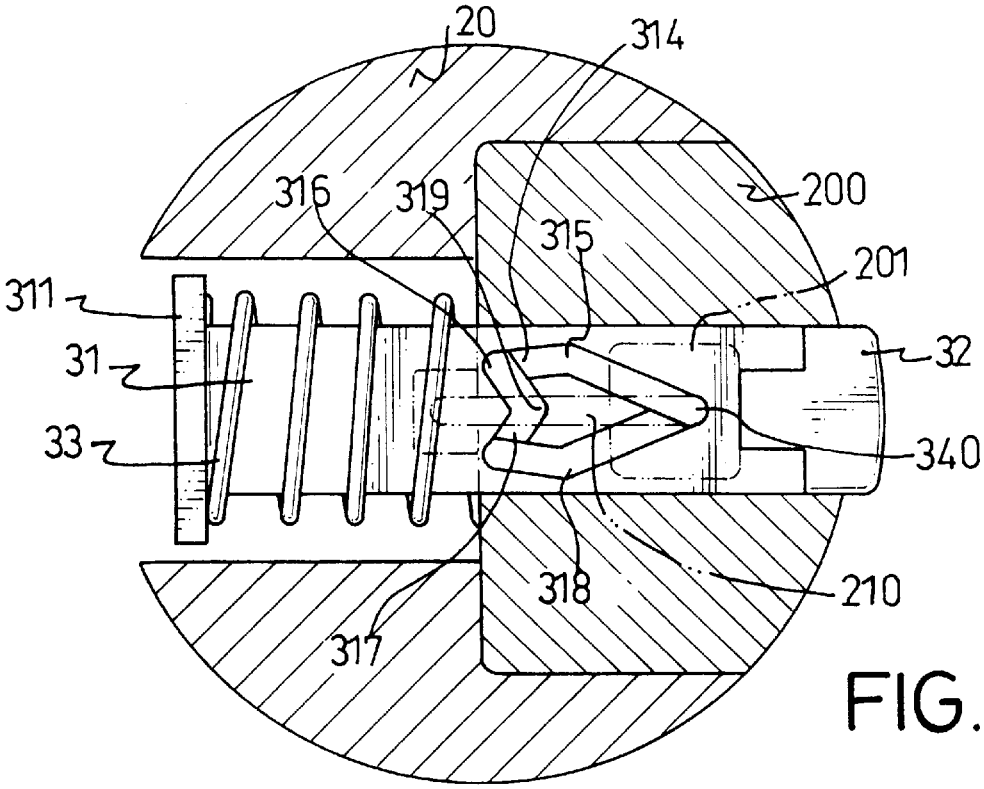
FIG. 7 is a top plan cross-sectional view of the locking and release member in the shaft of the beach umbrella in FIG. 4.

To open the beach umbrella, the cord (13) is pulled and the runner (110) moves up and pushes the lug (111) on the lever (11), and the flat head (112) pushes the locking bar (31) to the top situation and the extension block (32) extends through the hollow shaft (10) to stop the runner (110) from falling. With reference to FIG. 7, at the same time, the second end of the linkage (210) is moving from the tip (340) of the triangular groove (314) to the bottom in the first portion (315). When the runner ( 10) moves down and comes in contact with the extension block (32) of the locking member (30), the spring (33) pushes the locking bar (31) back and the second end of the linkage (210) moves from the bottom to the socket (319) in the second portion (316).

Figure 8:
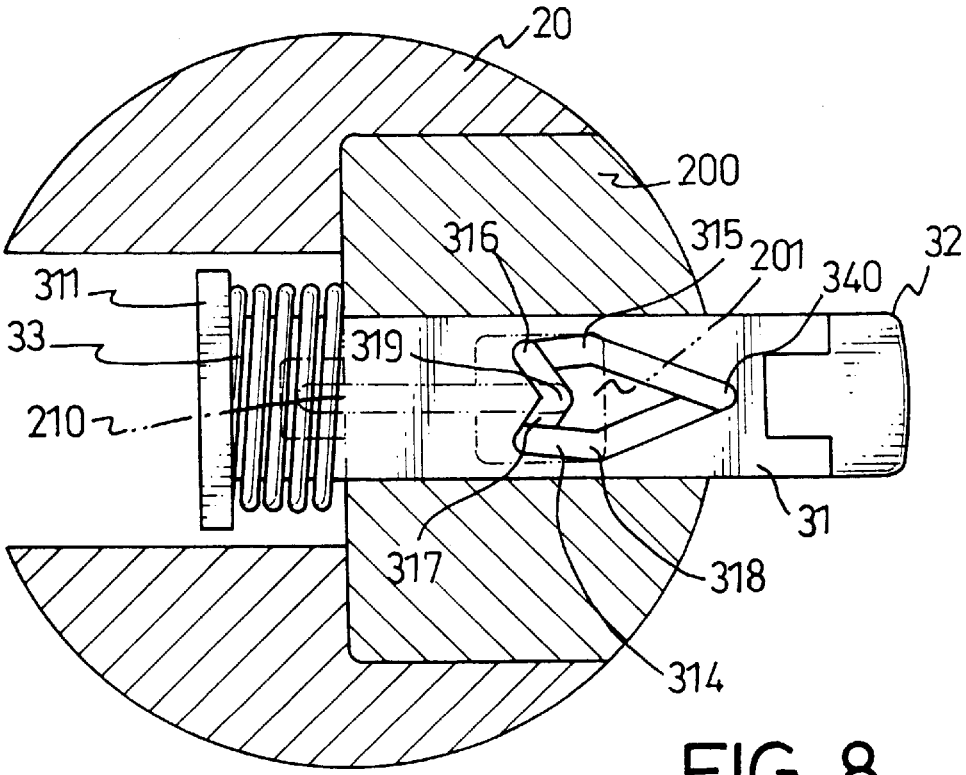
FIG. 8 is a top plan cross-sectional view of the locking and release member in the shaft of the beach umbrella in FIG. 4.

With reference to FIG. 8, to close the beach umbrella, the cord (13) is pulled and the runner (110) moves up and pushes the lug (111) of the lever (11). Then the flat head (112) pushes the locking bar (10) to the top situation again, and the second end of the linkage (210) moves from the socket (319) of the triangular groove (314) to the bottom in the third portion (315). When the runner (110) moves down, the spring pushes the locking bar (31), and the second end of the linkage (210) moves from the bottom to the tip (340) in the fourth portion (318) and the locking bar (31) goes back into the hollow shaft to allow the runner (110) to move downward, and the beach umbrella is closed.

Although the invention has been explained in relation to its preferred embodiment, it is to be understood that many other possible modifications and variations can be made without departing from the spirit and scope of the invention as hereinafter claimed.

What is claimed is:

1. An automatic locking and release device for a beach umbrella comprising:

a hollow shaft containing a first opening and a second opening therein;

a lever pivotally mounted in said hollow shaft;

a base member securely received in said hollow shaft, and containing two holes, a recessed cavity, and a channel, said cavity being perpendicular to said channel;

a locking member movably mounted in said base member; and a fastener having a lower portion said fastener defining a cavity a boss extending therefrom and containing a bore, a groove defined in a lower portion thereof and movably receiving said locking member therein, a U-shaped linkage having a first end pivotally received in said bore of said boss and a second end moving in said cavity of said fastener, and said first end of said linkage being shorter than said second end of said linkage, and two through holes, said two through-holes being aligned with said holes of said base member.

2. The automatic locking and release device for a beach umbrella in accordance with claim 1, wherein said locking member extends through said groove of said fastener and includes a locking bar having a button with a first side and a second side on the first end, a tang extending from the second end and a pair of indentations contained therein.

3. The automatic locking and release device for a beach umbrella in accordance with claim 2, wherein said locking member includes a triangular groove having a tip and a bottom containing a socket and movably receiving said second end of said linkage therein.

4. The automatic locking and release device for a beach umbrella in accordance with claim 3, wherein said locking member includes a first portion, a second portion abutting said first portion, a third portion abutting said second portion, and a fourth portion abutting said third portion and said first portion, said first portion has a taper and said socket is higher than said tip, and said fourth portion has a taper and said socket is lower than said tip.

5. The automatic locking and release device for a beach umbrella in accordance with claim 6, wherein said locking member further includes an extension block, said extension block has a chamber to receive said tang therein and two hooks attaching to said indentations of said locking bar, said spring has a first end abutting said second side of said button and a second end abutting said first end of said linkage.

6. The automatic locking and release device for a beach umbrella in accordance with claim 2, wherein said lever includes a lug extending through said first opening and a flat head abutting said first side of said button.

7. The automatic locking and release device for a beach umbrella in accordance with claim 10 further comprising a runner movably mounted around said hollow shaft and moving to push said lug of said lever, and a stop ring mounted on said hollow shaft to prevent said runner from moving beyond said lug.

* * * * *